US010167660B2

(12) United States Patent
Ficker

(10) Patent No.: US 10,167,660 B2
(45) Date of Patent: Jan. 1, 2019

(54) MULTI-AXIS HINGES AND CONTAINERS INCLUDING THE SAME

(71) Applicant: Buckhorn, Inc., Milford, OH (US)

(72) Inventor: Paul J. Ficker, Cincinnati, OH (US)

(73) Assignee: BUCKHORN, INC., Milford, OH (US)

( * ) Notice: Subject to any disclaimer, the term of this patent is extended or adjusted under 35 U.S.C. 154(b) by 102 days.

(21) Appl. No.: 15/255,375

(22) Filed: Sep. 2, 2016

(65) Prior Publication Data

US 2017/0074017 A1 Mar. 16, 2017

Related U.S. Application Data

(60) Provisional application No. 62/217,079, filed on Sep. 11, 2015.

(51) Int. Cl.

| | |
|---|---|
| ***E05D 15/48*** | (2006.01) |
| ***B65D 19/18*** | (2006.01) |
| ***B65D 25/00*** | (2006.01) |
| ***E05D 3/02*** | (2006.01) |
| ***E06B 5/00*** | (2006.01) |
| ***B65D 19/38*** | (2006.01) |

(52) U.S. Cl.

CPC ..... *E05D 15/48* (2013.01); *B65D 19/18* (2013.01); *B65D 19/38* (2013.01); *B65D 25/005* (2013.01); *E05D 3/02* (2013.01); *E06B 5/00* (2013.01); *B65D 2519/009* (2013.01); *B65D 2519/00034* (2013.01); *B65D 2519/00069* (2013.01);

(Continued)

(58) Field of Classification Search

CPC ..... B65D 19/18; B65D 19/06; B65D 19/38; B65D 25/005; B65D 43/169; B65D 43/20; B65D 43/16; B65D 51/18; B65D 11/1866; B65D 11/1873; B65D 43/18; E05D 15/48; E05D 3/02; E05D 3/18; E06B 5/00

USPC ..... 220/254.6, 254.4, 254.3, 254.1, 259.1, 220/256.1, 4.34, 4.33, 4.28, 826, 813, 220/812, 811, 810, 6, 822, 821, 820, 819, 220/818, 817; 206/600, 386; 16/366

See application file for complete search history.

(56) References Cited

U.S. PATENT DOCUMENTS 3,330,612 A * 7/1967 Masterson ..... E06B 3/385 217/60 R
4,014,458 A * 3/1977 Berges ..... B65D 7/12 220/1.5

(Continued)

FOREIGN PATENT DOCUMENTS

CN 102582912 A 7/2012
EP 1870343 A1 * 12/2007 ..... B65D 19/12

(Continued)

*Primary Examiner* — Robert J Hicks

(74) *Attorney, Agent, or Firm* — Benesch Friedlander Coplan & Aronoff LLP

(57) ABSTRACT

According to the embodiments provided herein, a multi-axis hinge can include a fixed axis body and an articulating body. The fixed axis body and the articulating body can be in rotational engagement and can be configured to rotate with respect to one another around a hinge rotational axis. The fixed axis body can include a first pillar and a second pillar that extends away from the hinge rotational axis. The first pillar and the second pillar can each include a panel engagement member. The articulating body can include a first articulating pillar and a second articulating pillar that extends away from the hinge rotational axis. The first articulating pillar and the second articulating pillar can each include a door engagement member.

16 Claims, 12 Drawing Sheets

(52) U.S. Cl.
CPC ..... *B65D 2519/00174* (2013.01); *B65D 2519/00273* (2013.01); *B65D 2519/00293* (2013.01); *B65D 2519/00323* (2013.01); *B65D 2519/00338* (2013.01); *B65D 2519/00497* (2013.01); *B65D 2519/00502* (2013.01); *B65D 2519/00611* (2013.01); *B65D 2519/00646* (2013.01); *B65D 2519/00805* (2013.01); *E05D 2015/485* (2013.01); *E05Y 2900/602* (2013.01)

(56) References Cited

U.S. PATENT DOCUMENTS

| | | | | |
|---|---|---|---|---|
| 5,938,059 | A * | 8/1999 | Luburic | B65D 11/1833 220/4.32 |
| 7,331,480 | B1 | 2/2008 | Nolan | |
| 2002/0070215 | A1 * | 6/2002 | Walsh | B65D 19/18 220/6 |
| 2008/0169285 | A1 * | 7/2008 | Marazita | B65D 19/18 220/7 |
| 2013/0175265 | A1 * | 7/2013 | Sommer | B65D 11/1833 220/4.28 |

FOREIGN PATENT DOCUMENTS

| | | | |
|---|---|---|---|
| GB | 2015968 | A | 9/1979 |
| GB | 2357078 | A | 6/2001 |
| GB | 2426237 | A | 11/2006 |
| WO | 2009/023830 | A1 | 2/2009 |

* cited by examiner

MULTI-AXIS HINGES AND CONTAINERS INCLUDING THE SAME

CROSS-REFERENCE TO RELATED APPLICATIONS

This application claims priority from U.S. Provisional Patent Application No. 62/217,079, filed on Sep. 11, 2015, which is incorporated by reference herein in its entirety.

BACKGROUND

The present specification generally relates to hinges for opening doors in a container and, more specifically, to hinges that provide multiple axes of rotation for a door of a shipping container.

Containers can be utilized to assist with transporting and storing goods of various size, weight, and composition. For example, a container can be provided as a box that provides a top opening for loading goods into the box. The container can include a lower interface for handling by a transport device. Typical transport devices can include forklifts, pallet jacks, front loaders, or the like. Some containers can be provided with drop down doors to facilitate the loading of goods into a container by expanding the size of the top opening.

However, the drop down doors can weaken the structure of the container by providing a point of failure. Accordingly, goods may be lost or damaged should the door fail. Some containers include locking features that secure the door to the container. However, such locking features can be complex and make the door inefficient to open. Further, such locking features may alter the opening geometry and prevent the door from fully opening. The door can thus create an obstruction that makes the container more difficult to load and reduces the efficacy of the door.

Accordingly, a need exists for alternative hinges that provide multiple axes of rotation for a door of a shipping container.

SUMMARY

In one embodiment, a multi-axis hinge can include a fixed axis body and an articulating body. The fixed axis body and the articulating body can be in rotational engagement and can be configured to rotate with respect to one another around a hinge rotational axis. The fixed axis body can include a first pillar and a second pillar that extends away from the hinge rotational axis. The first pillar and the second pillar can each include a panel engagement member. The articulating body can include a first articulating pillar and a second articulating pillar that extends away from the hinge rotational axis. The first articulating pillar and the second articulating pillar can each include a door engagement member.

In another embodiment, a container can include a multi-axis hinge, an access panel, and a door. The multi-axis hinge can include a fixed axis body and an articulating body. The fixed axis body and the articulating body can be in rotational engagement and can be configured to rotate with respect to one another around a hinge rotational axis. The access panel can comprise a doorway that forms a recess that extends from an upper perimeter of the container towards a base of the container. The fixed axis body of the multi-axis hinge can be in rotational engagement with the access panel. The door can be configured to selectively close and open with respect to the doorway. The articulating body of the multi-axis hinge can form a rotational and sliding engagement with the door.

In a further embodiment, a container can include a multi-axis hinge, an access panel, and a door. The multi-axis hinge can include a fixed axis body and an articulating body. The fixed axis body and the articulating body can be in rotational engagement and can be configured to rotate with respect to one another around a hinge rotational axis. The access panel can comprise a doorway that forms a recess that extends from an upper perimeter of the container towards a base of the container. The fixed axis body of the multi-axis hinge can be in rotational engagement with the access panel to define a fixed axis of rotation. The door can be configured to selectively close and open with respect to the doorway. The articulating body of the multi-axis hinge can form a rotational and sliding engagement with the door to define a sliding rotational axis.

According to any of the multi-axis hinges and containers provided herein, the access panel can include one or more pocket members formed adjacent to the doorway, and the door can include one or more peg members configured to selectively lock with the pocket members of the access panel. Rotation of the door around the fixed axis of rotation can be mitigated, when the one or more peg members are locked with the one or more pocket members.

According to any of the multi-axis hinges and containers provided herein, the door can translate with respect to the sliding rotational axis between a first state and a second state. When in the first state, the door can enclose the doorway, and rotation of the door around the fixed axis of rotation can be mitigated. When in the second state, the door can enclose the doorway, and rotation of the door around the fixed axis of rotation can be permitted. Alternatively or additionally, when in the first state, the fixed axis of rotation, the hinge rotational axis, and the sliding rotational axis can be constrained into substantially linear alignment. Alternatively or additionally, the access panel can include an inner bounding feature that delimits the motion of the door with respect to the fixed axis of rotation. Alternatively or additionally, the multi-axis hinge can rotate with respect to the fixed axis of rotation, the hinge rotational axis, and the sliding rotational axis between the second state and an additional state. When in the additional state, an exterior surface of the door can contact an exterior surface of the access panel. Alternatively or additionally, when in the additional state, the door lays flat with respect to the access panel.

According to any of the multi-axis hinges and containers provided herein, the multi-axis hinge can include a stop feature that sets a predetermined angle between the fixed axis body and the articulating body with respect to the hinge rotational axis. Alternatively or additionally, the predetermined angle can be between 75° and 105°.

According to any of the multi-axis hinges and containers provided herein, the fixed axis body can include a pillar extending from the hinge rotational axis towards the fixed axis of rotation and including a panel engagement member. The panel engagement member can be in rotational engagement with the access panel along the fixed axis of rotation. Alternatively or additionally, the panel engagement member can include a substantially cylindrical pillar extending along the fixed axis of rotation. Alternatively or additionally, the panel engagement member can include a cylindrical bore formed along the fixed axis of rotation.

According to any of the multi-axis hinges and containers provided herein, the fixed axis body can include an articulating pillar extending from the hinge rotational axis towards the sliding rotational axis and including a door engagement member. The door engagement member can be in rotational and sliding engagement with the door. Alternatively or additionally, the door engagement member can include a substantially cylindrical pillar extending along the sliding rotational axis. Alternatively or additionally, the door engagement member can include an elongate slot.

Any of the multi-axis hinges and containers provided herein can include or be formed from a thermoplastic material.

According to any of the multi-axis hinges and containers provided herein, a cantilevered detent can extend from one or more of a first pillar of the fixed axis body, a second pillar of the fixed axis body, a first articulating pillar of the articulating body, and a second articulating pillar of the articulating body.

According to any of the multi-axis hinges and containers provided herein, the first pillar of the fixed axis body, the second pillar of the fixed axis body, the first articulating pillar of the articulating body, and the second articulating pillar of the articulating body can form an "H" shape.

According to any of the multi-axis hinges and containers provided herein, the fixed axis body and the articulating body can each include an angled face that bounds the motion of the fixed axis body and the articulating body around the hinge rotational axis at a predetermined angle. The predetermined angle can be between 75° and 105°.

According to any of the multi-axis hinges and containers provided herein, the first pillar of the fixed axis body can extend a shorter length than the first articulating pillar.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
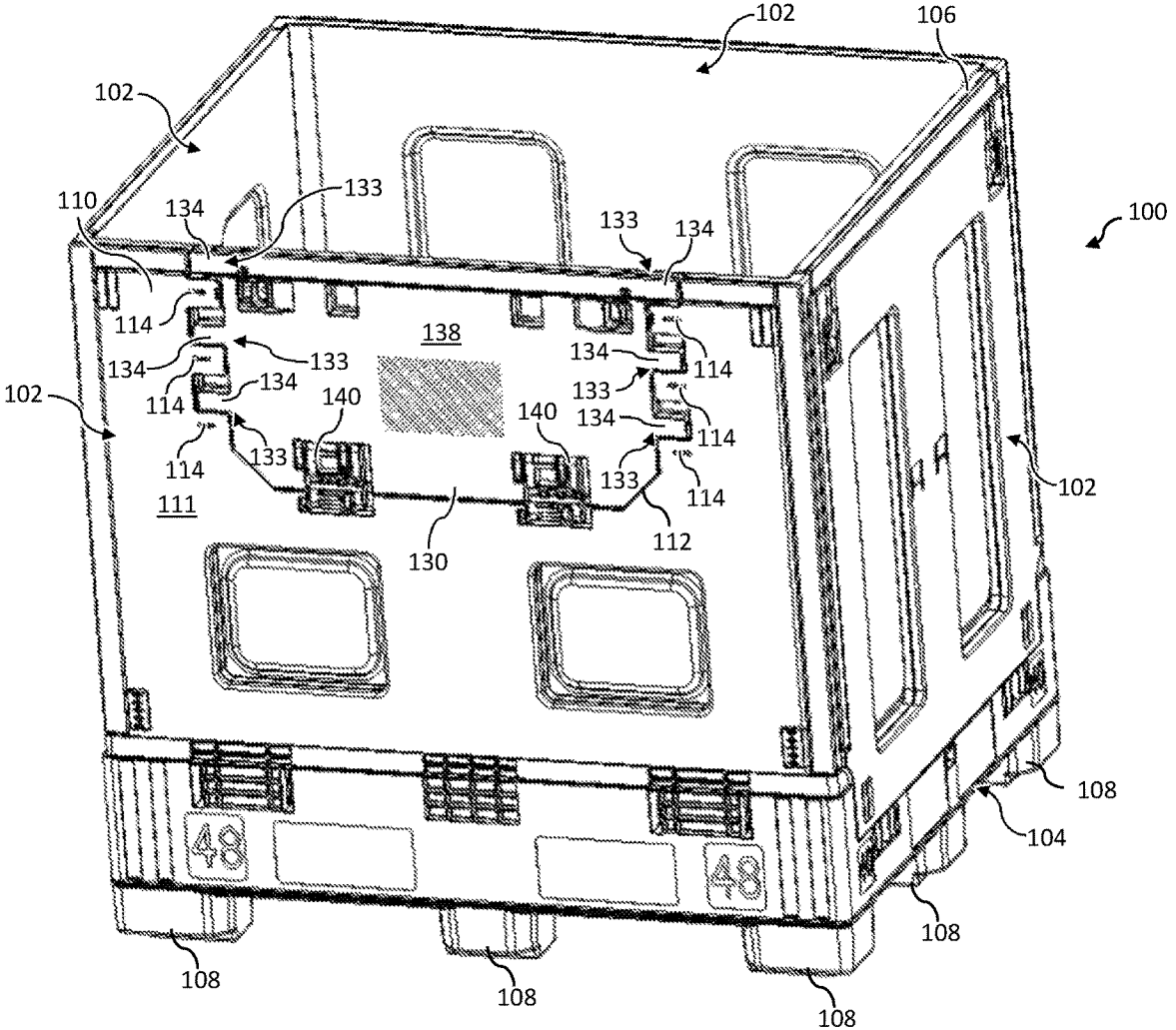
FIG. 1 schematically depicts a container with multi-axis hinges and a closed door according to one or more embodiments shown and described herein.
Figure 2:
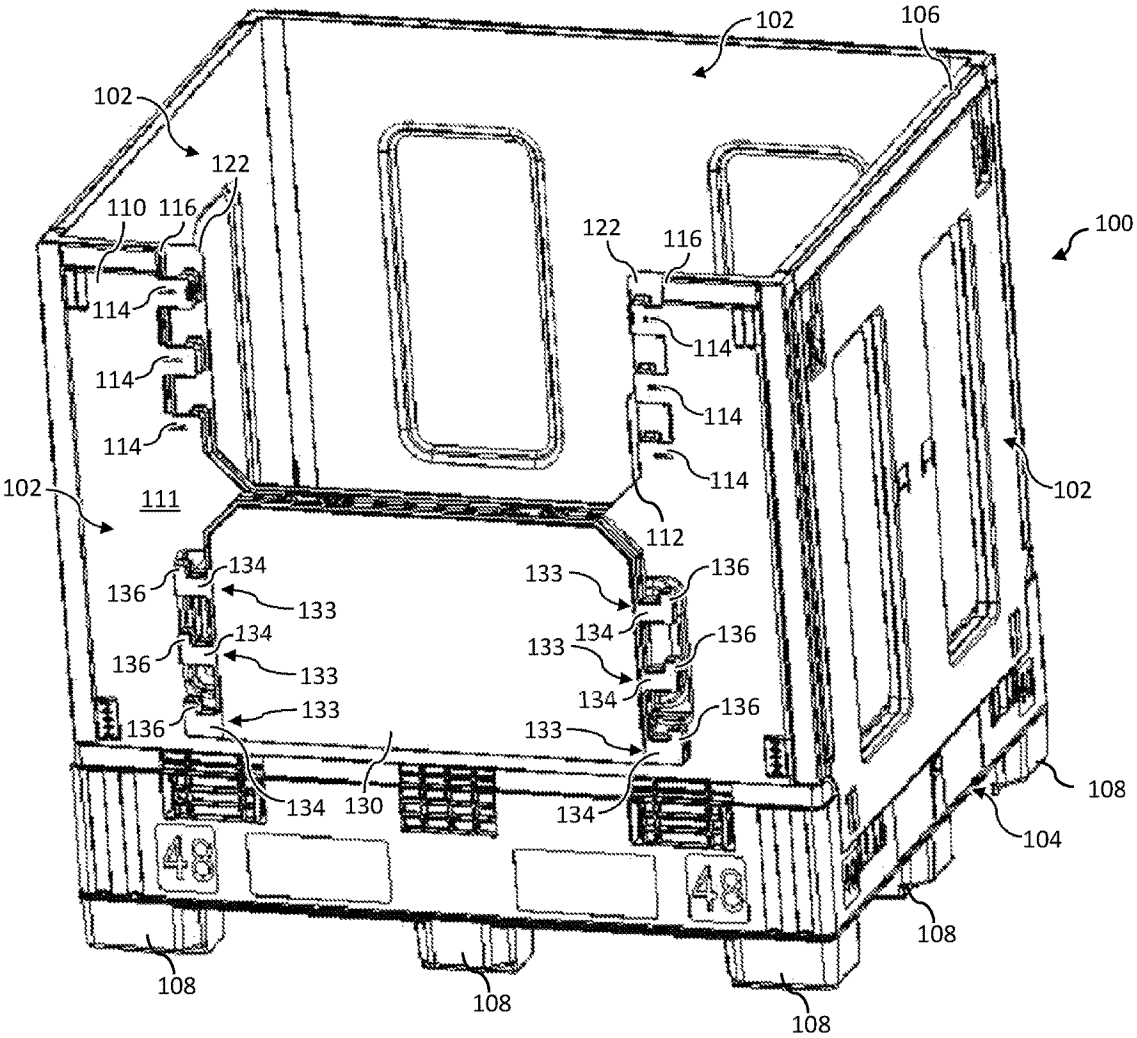
FIG. 2 schematically depicts the container of FIG. 1 with an open door according to one or more embodiments shown and described herein.

Referring collectively to FIGS. 1 and 2, an embodiment of the container 100 is schematically depicted. In some embodiments, the container 100 can be formed from thermoplastic material such as, for example, Acrylonitrile butadiene styrene (ABS), Polycarbonate, Polyethylene, Polypropylene, or any other heat moldable polymer. The container 100 can be configured to store and at least partially enclose goods. For example, the container 100 can comprise a plurality of walls 102 that extend vertically from a base 104 to an upper perimeter 106 that forms an enclosure. For example, the plurality of walls 102 and the base 104 can form a substantially rectangular shaped upper perimeter 106. The upper perimeter 106 can bound an opening that can be used to access the enclosure. The container 100 can furthermore be configured to be loaded and unloaded with devices such as, for example, a forklift, hand pallet truck, or the like. Accordingly, the container 100 can comprise feet 108 that raise the container 100 with respect to a work surface. The feet 108 can be offset to allow the forks of a forklift to be received beneath the base 104 of the container 100 and the work surface.

Figure 3:
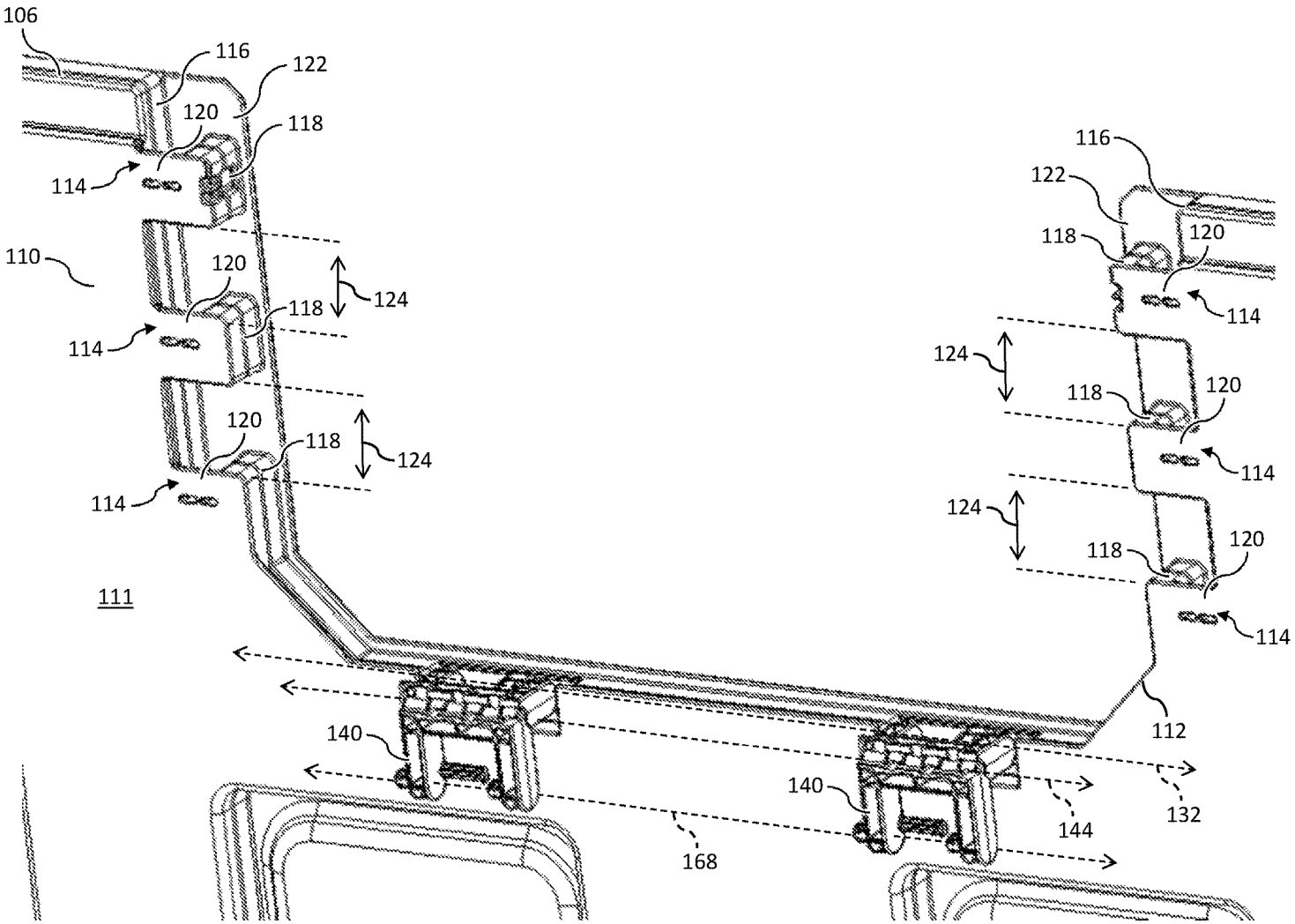
FIG. 3 schematically depicts an enlarged view of the doorway of the container of FIG. 2 with the door removed according to one or more embodiments shown and described herein.
Figure 4:
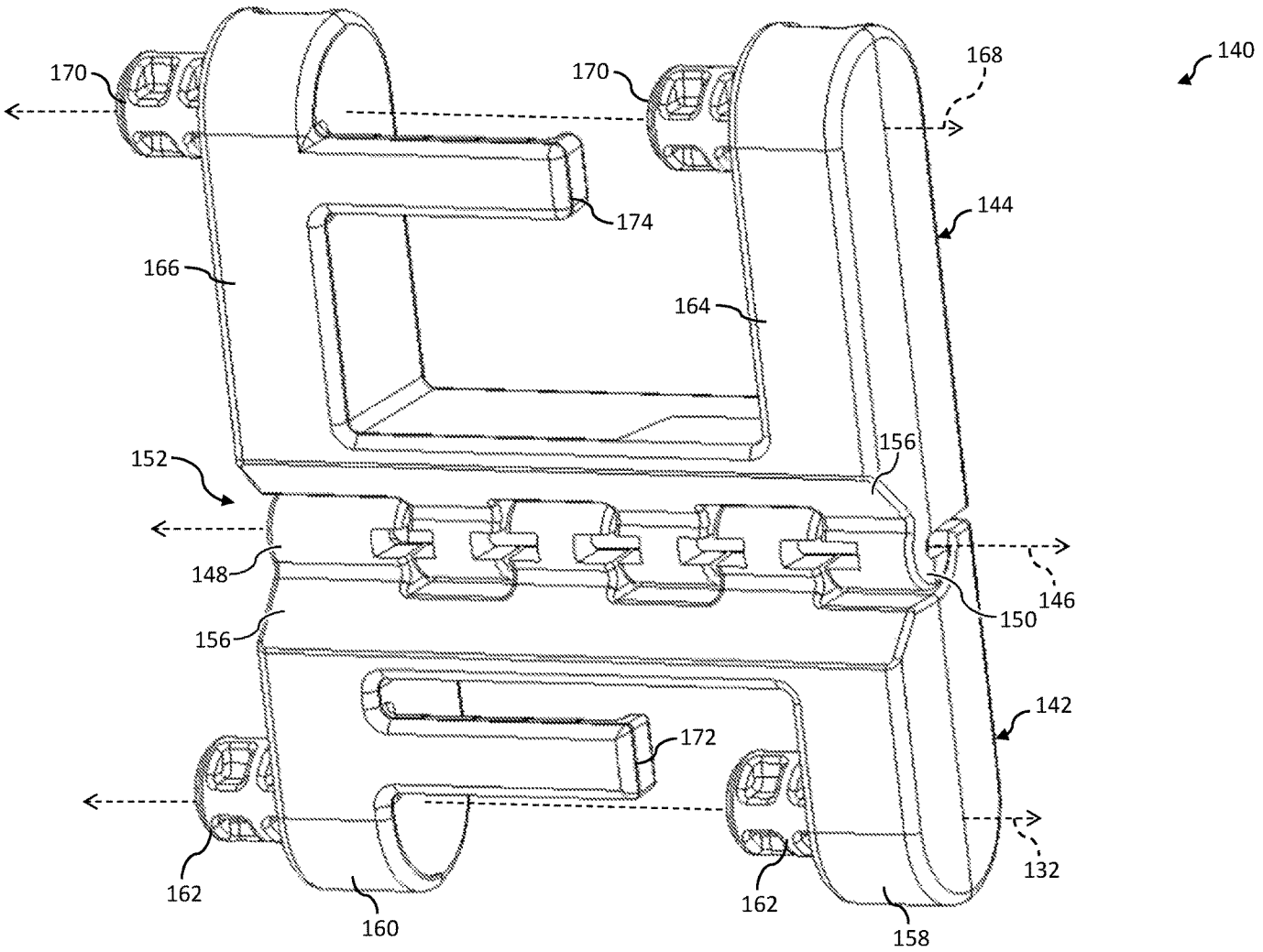
FIG. 4 schematically depicts a multi-axis hinge according to one or more embodiments shown and described herein.
Figure 5:
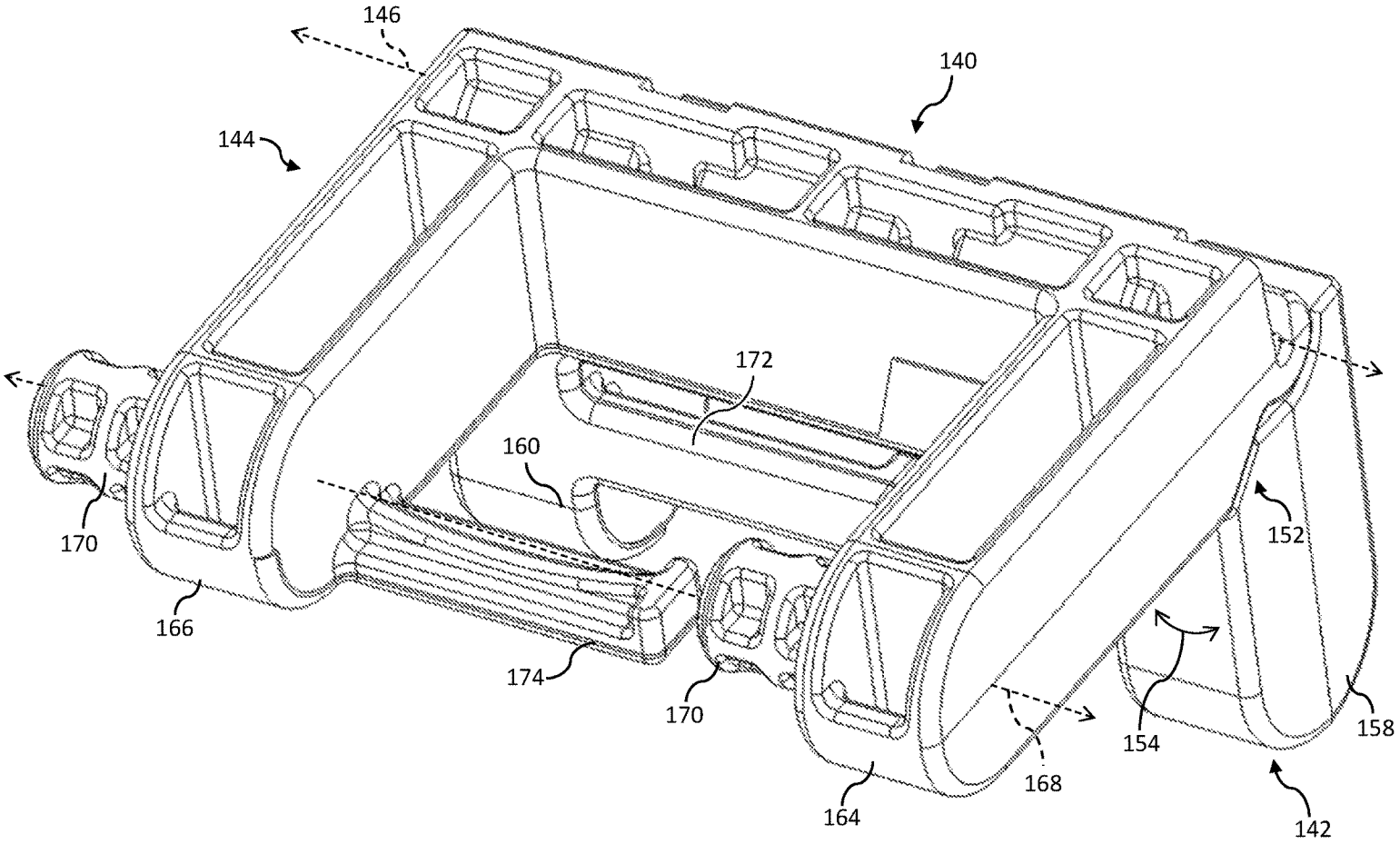
FIG. 5 schematically depicts the multi-axis hinge of FIG. 4 rotated to a predetermined angle according to one or more embodiments shown and described herein.

Referring collectively to FIGS. 1-3, one or more of the walls 102 can be provided as an access panel 110 that is configured to provide additional access to the enclosure formed by the container 100. The access panel 110 can comprise a doorway 112 that is formed through the access panel 110. Specifically, the doorway 112 can form a recess that extends from the upper perimeter 106 of the container 100 towards the base 104 of the container 100. Accordingly, the enclosure can be accessed at a relatively lower height with respect to a work surface through the doorway 112 compared to the upper perimeter 106. In some embodiments, the doorway 112 can be substantially rectangular shaped. Alternatively or additionally, the doorway 112 can comprise beveled corners.

The access panel 110 can comprise one or more pocket members 114 configured to selectively prevent motion of a door 130 with respect to a fixed axis of rotation 132. Specifically, the pocket member 114 can form a cavity adjacent to the doorway 112. For example, each pocket member 114 can form a cavity along a transitional feature 116 that is positioned along the access panel 110 adjacent to the doorway 112. In some embodiments, the pocket member 114 can comprise a spacer 118 offset from the transitional feature 116 such that the spacer is nearer to the doorway 112 than the transitional feature 116. The pocket member 114 can further comprise an outer bounding feature 120 that spans the distance between the transitional feature 116 and the spacer 118. The outer bounding feature 120 can be thinner than the transitional feature 116 and the spacer 118. Accordingly, a cavity can be formed by the transitional feature 116, the spacer 118, and the outer bounding feature 120. Alternatively or additionally, the access panel 110 can comprise an inner bounding feature 122 configured to delimit the motion of the door 130 with respect to the fixed axis of rotation 132. In some embodiments, the inner bounding feature 122 can extend from the doorway 112 towards the transitional feature 116. The inner bounding feature 122 can be offset from the outer bounding feature 120 by the spacer 118. Accordingly, the cavity can be located between the outer bounding feature 120 and the inner bounding feature 122.

In embodiments with multiple pocket members 114, the pocket members 114 can be arranged in a substantially serrated pattern. For example, the pocket members 114 can be aligned in a substantially linear column and separated from one another. Each outer bounding feature 120 can form projections having a span 124 there between. In some embodiments, the inner bounding feature 122 can be larger than the outer bounding feature 120. Accordingly, the inner bounding feature 122 can at least partially cover the span 124 between each of the pocket members 114.

Referring again to FIGS. 1-2, the container 100 can comprise a door 130 that is configured to selectively close (FIG. 1) and open (FIG. 2) the door 130 with respect to the doorway 112. Accordingly, the door 130 can be a body that is correspondingly shaped to the doorway 112 of the container 100. In some embodiments, the door 130 can comprise one or more peg members 133 that are configured to selectively lock with the pocket members 114 of the access panel 110. The peg members 133 can comprise a projecting member 134 that extends away from the door 130 and a locking member 136 that extends away from the projecting member 134. In some embodiments, the projecting member 134 can be cantilevered from the door 130. The locking member 136 can extend away from a distal end of the projecting member 134 such that the locking member 136 is offset from the door 130. In one embodiment, the locking member 136 and the projecting member 134 can form a substantially "L" shaped body.

The locking member 136 can be configured to engage with the pocket member 114 of the doorway 112. Accordingly, the locking member 136 can be shaped to fit within the cavity bounded by the pocket member 114, i.e., the locking member 136 can be correspondingly shaped to the cavity. Alternatively or additionally, the locking member 136 can extend from the projecting member 134 towards the pocket member 114, when the door 130 is in the closed position. For example, when the door 130 is in the closed position, the locking member 136 can extend substantially downwards from the projecting member 134.

Referring collectively to FIGS. 1 and 3-5, the container 100 can comprise a multi-axis hinge 140 that is configured to facilitate articulation of the door 130 with respect to the doorway 112. The multi-axis hinge 140 can comprise a fixed axis body 142 in rotational engagement with an articulating body 144. In some embodiments, the fixed axis body 142 and the articulating body 144 can be configured to rotate with respect to one another around a hinge rotational axis 146. For example, the fixed axis body 142 can comprise a first joint member 148 and the articulating body 144 can comprise a second joint member 150. The first joint member 148 and the second joint member 150 can form a plurality of correspondingly shaped knuckles that can be in rotational engagement and configured to rotate with respect to one another around the hinge rotational axis 146. For example, in some embodiments, the plurality of correspondingly shaped knuckles of the first joint member 148 and the second joint member 150 can receive a pin. The pin can be aligned with the hinge rotational axis 146 such that the knuckles form a serrated joint that permits rotation of the fixed axis body 142 and the articulating body 144. Alternatively, the plurality of correspondingly shaped knuckles of the first joint member 148 and the second joint member 150 can interlock (e.g., snap fit), without a pin, to form the rotational engagement.

The multi-axis hinge 140 can comprise a stop feature 152 configured to set a predetermined angle 154 between the fixed axis body 142 and the articulating body 144 with respect to the hinge rotational axis 146. In some embodiments, the first joint member 148, the second joint member 150, or both can comprise an angled face 156 positioned adjacent to the hinge rotational axis 146. For example, each of the first joint member 148 and the second joint member 150 can comprise an angled face 156 that bounds the motion of the fixed axis body 142 and the articulating body 144 around the hinge rotational axis 146. Thus, when the angled faces 156 come into contact, additional rotation of the fixed axis body 142 and the articulating body 144 around the hinge rotational axis 146 can be mitigated. In some embodiments, the predetermined angle 154 can be between about 75° and about 105° such as, for example, between about 80° and about 100° in one embodiment, or between about 80° and about 95°.

The fixed axis body 142 can comprise a first pillar 158 and a second pillar 160 configured to offset the hinge rotational axis 146 from the fixed axis of rotation 132. Specifically, each of the first pillar 158 and the second pillar 160 can be an elongate body that extends away from the first joint member 148 of the fixed axis body 142. In some embodiments, the first pillar 158 and the second pillar 160 can be offset from one another along the fixed axis of rotation 132. In one embodiment, the first pillar 158 and the second pillar 160 can be substantially parallel. Each of the first pillar 158 and the second pillar 160 can comprise a panel engagement member 162 that is configured to form a rotational engagement with the access panel 110 along the fixed axis of rotation 132. Accordingly, the panel engagement member 162 can be offset from the first joint member 146 of the fixed axis body 142. In some embodiments, the panel engagement member 162 can be a substantially cylindrical pillar that extends from one or both of the first pillar 158 and the second pillar 160 and along the fixed axis of rotation 132. Alternatively or additionally, the panel engagement member 162 can be a cylindrical bore (FIG. 6) formed in one or both of the first pillar 158 and the second pillar 160 and along the fixed axis of rotation 132. It is noted that in embodiments where the panel engagement members 162 extend from the first pillar 158 and the second pillar 160, the panel engagement members 162 can extend in substantially the same direction.

The articulating body 144 can comprise a first articulating pillar 164 and a second articulating pillar 166 configured to offset a sliding rotational axis 168 from the fixed axis of rotation 132. Specifically, each of the first articulating pillar 164 and the second articulating pillar 166 can be an elongate body that extends away from the second joint member 150 of the articulating body 144. In some embodiments, the first articulating pillar 164 and the second articulating pillar 166 can be offset from one another along the sliding rotational axis 168. In one embodiment, the first articulating pillar 164 and the second articulating pillar 166 can be substantially parallel. Each of the first articulating pillar 164 and the second articulating pillar 166 can comprise a door engagement member 170 that is configured to form a sliding and rotational engagement with the door 130 such that the door 130 can slide with and rotate along the sliding rotational axis 168. Accordingly, the door engagement member 170 can be offset from the second joint member 150 of the articulating body 144. In some embodiments, the door engagement member 170 can be a substantially cylindrical pillar that extends from one or both of the first articulating pillar 164 and the second articulating pillar 166 and along the sliding rotational axis 168. Alternatively or additionally, the door engagement member 170 can be an elongate slot (FIG. 6, which depicts an alternative embodiment of a multi-axis hinge 240) formed in one or both of the first articulating pillar 164 and the second articulating pillar 166. It is noted that in embodiments where the door engagement members 170 extend from the first articulating pillar 164 and the second articulating pillar 166, the door engagement members 170 can extend in substantially the same direction.

According to the embodiments described herein, the multi-axis hinge 140 can be substantially "H" shaped. For example, the first pillar 158 of the fixed axis body 142 can be aligned with the first articulating pillar 164 of the articulating body 144 and the second pillar 160 of the fixed axis body 142 can be aligned with the second articulating pillar 166 of the articulating body 144. Alternatively or additionally, the hinge rotational axis 146 can be offset from the fixed axis of rotation 132 by a distance that is less than the offset between the hinge rotational axis 146 and the sliding rotational axis 168. Accordingly, the first pillar 158 of the fixed axis body 142 can extend a shorter length than the first articulating pillar 164, the second articulating pillar 166, or both. Likewise, the second pillar 160 of the fixed axis body 142 can extend a shorter length than the first articulating pillar 164, the second articulating pillar 166, or both.

The multi-axis hinge 140 can also comprise one or more cantilevered detents configured to couple the multi-axis hinge 140 to the container 100. For example, the fixed axis body 142 can comprise a first cantilevered detent 172 that extends from the second pillar 160 towards the first pillar 158. The first cantilevered detent 172 can be substantially aligned with the fixed axis of rotation 132. In some embodiments, the first cantilevered detent 172 can extend only partially across the span between the second pillar 160 and the first pillar 158. Alternatively or additionally, the articulating body 144 can comprise a second cantilevered detent 174 that extends from the second articulating pillar 166 towards the first articulating pillar 164. The second cantilevered detent 174 can be substantially aligned with the sliding rotational axis 168. In some embodiments, the second cantilevered detent 174 can extend only partially across the span between the second articulating pillar 166 and the first articulating pillar 164. Accordingly, the second cantilevered detent 174 can act as a follower to a surface substantially perpendicular to the hinge rotational axis 146 to guide articulation of the articulating body 144. It is noted that, while the first cantilevered detent 172 is depicted as extending from the second pillar 160, the first cantilevered detent 172 can extend from the first pillar 158 without departing from the scope of the present disclosure. Likewise, while the second cantilevered detent 174 is depicted as extending from the second articulating pillar 166, the second cantilevered detent 174 can extend from the first articulating pillar 164. It is furthermore noted that each of the first cantilevered detent 172 and the second cantilevered detent 174 can be configured to flex or deflect during installation of the multi-axis hinge 140 to the container 100.

Figure 6:
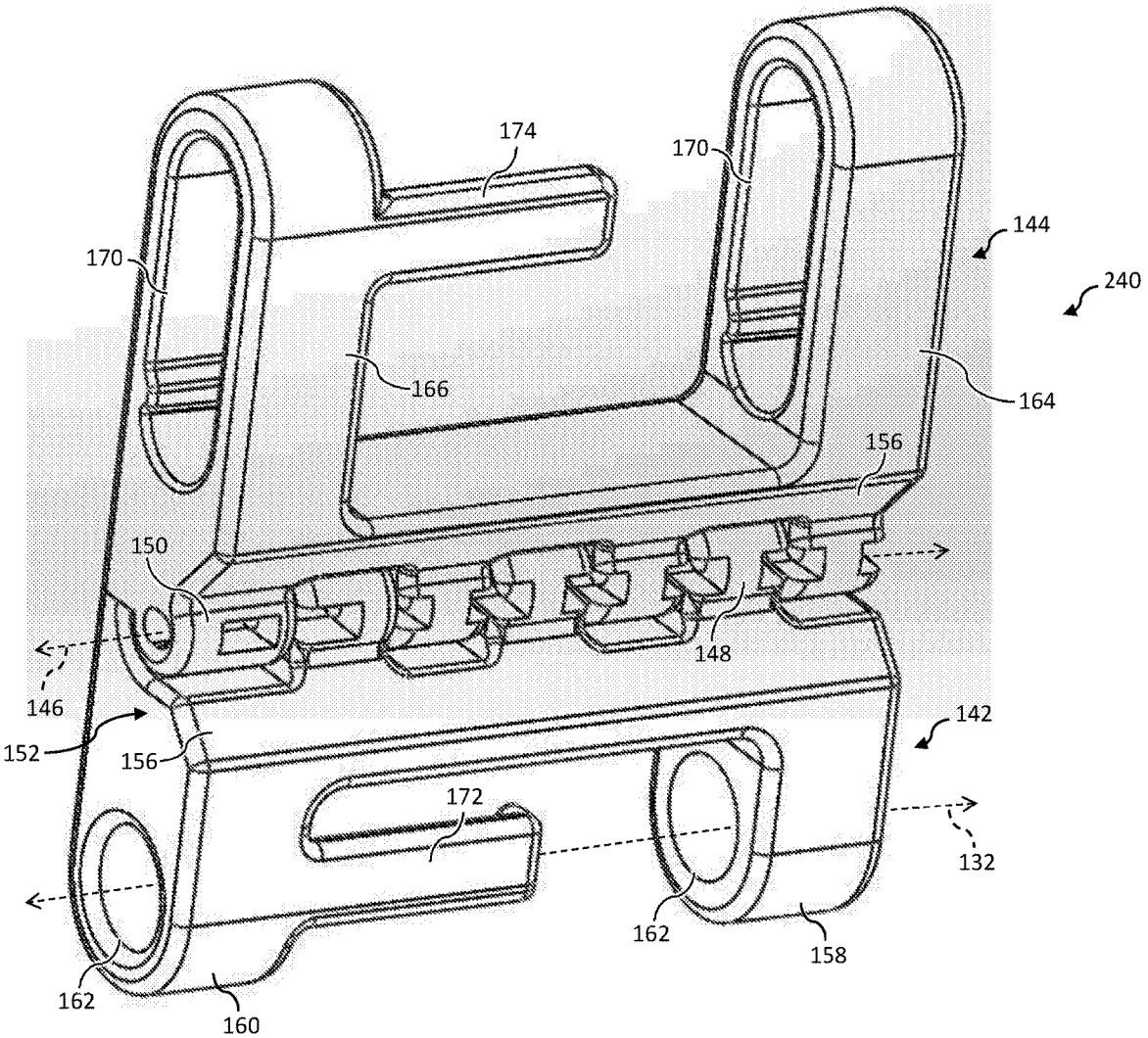
FIG. 6 schematically depicts a multi-axis hinge according to one or more embodiments shown and described herein.
Figure 7:
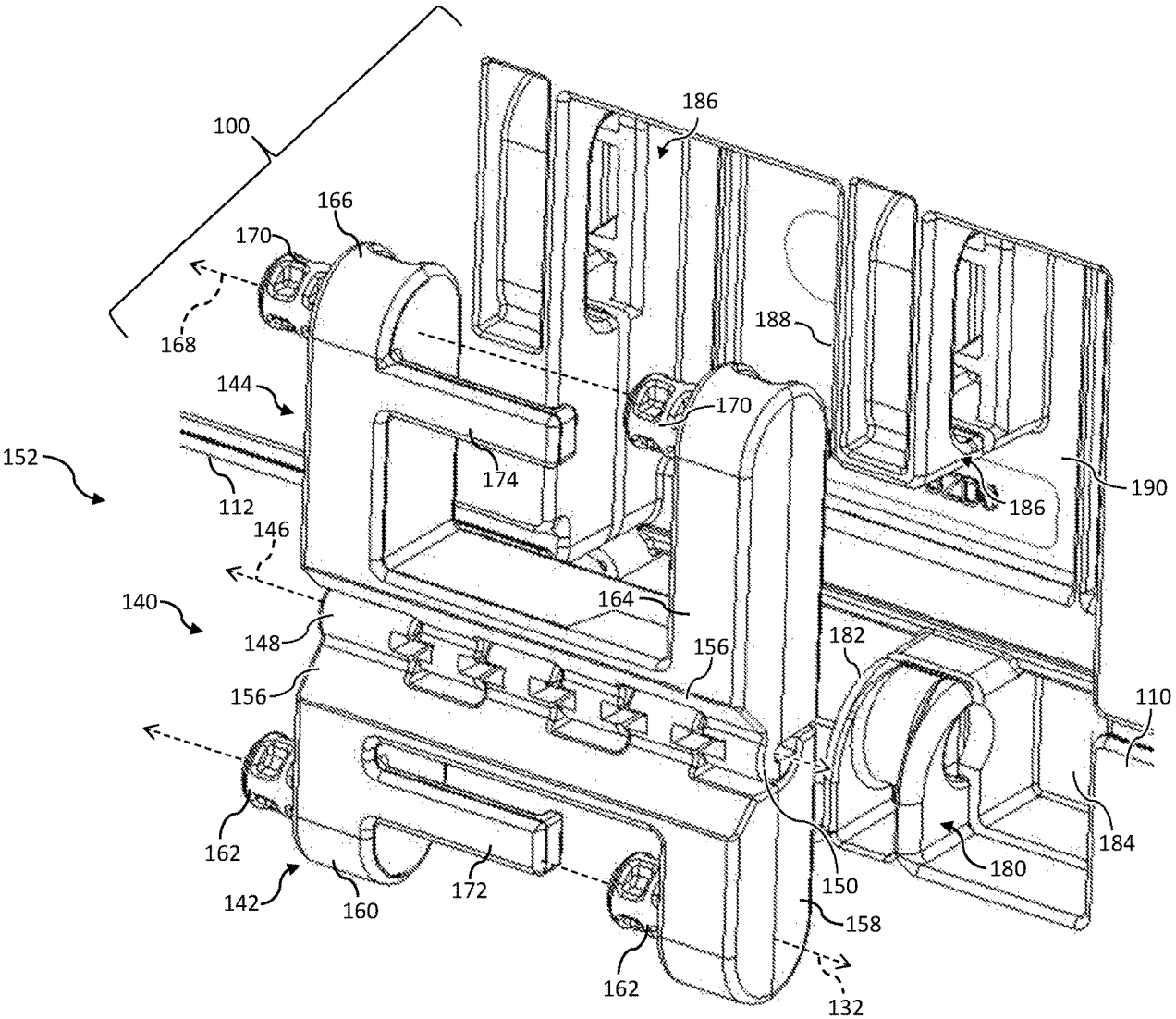
FIGS. 7 and 8 schematically depicts an enlarged view of the hinge of the container of FIG. 1 according to one or more embodiments shown and described herein.
Figure 8:
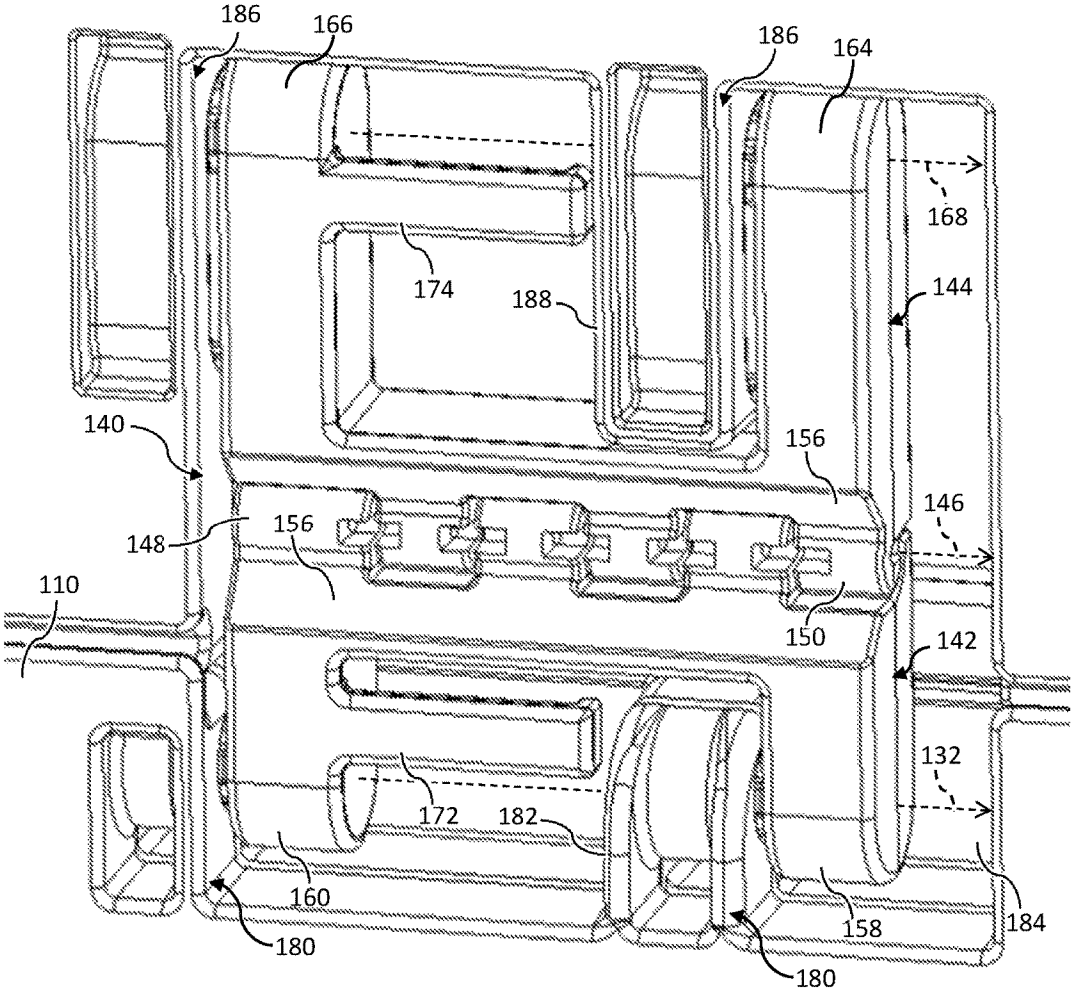

Referring collectively to FIGS. 1, 7 and 8, the multi-axis hinge 140 can be in rotational engagement with the access panel 110 to promote a sequence of motion of the door 130. In some embodiments, the access panel 110 can comprise one or more hinge engagement members 180 each configured to form a rotational engagement with the panel engagement member 162 of the fixed axis body 142 of the multi-axis hinge 140. Generally, the hinge engagement member 180 is correspondingly shaped to the panel engagement member 162. In some embodiments, the hinge engagement member 180 can comprise a substantially cylindrical bore configured to receive the panel engagement member. Alternatively or additionally, the hinge engagement member 180 can comprise a substantially cylindrical pillar configured to be received by the panel engagement member 162 (FIG. 6). According to the embodiments described herein, the hinge engagement member 180 can comprise a delimiting body 182 that extends away from the access panel 110. For example, the delimiting body 182 can extend from a panel recess 184 formed in the access panel 110 adjacent to the doorway 112. Thus, the delimiting body 182 can cooperate with the first cantilevered detent 172 to bound the motion of the fixed axis body 142, i.e., the delimiting body 184 and the first cantilevered detent 172 can mitigate separation of the hinge engagement member 180 and the panel engagement member 162.

The multi-axis hinge 140 can be in rotational and sliding engagement with the door 130 to promote a sequence of motion of the door 130. In some embodiments, the door 130 can comprise one or more sliding engagement members 186 each configured to form a rotational and sliding engagement with the door engagement member 170 of the articulating body 144 of the multi-axis hinge 140. Accordingly, the door 130 can translate with respect to the sliding rotational axis 168. Generally, the sliding engagement member 186 is correspondingly shaped to the door engagement member 170. In some embodiments, the sliding engagement members 186 can comprise an elongate slot configured to receive the door engagement member 170 in a rotational and sliding engagement. Alternatively or additionally, the sliding engagement members 186 can comprise a substantially cylindrical pillar configured to be received by the door engagement member 170 (FIG. 6). According to the embodiments described herein, the sliding engagement members 186 can comprise a guide body 188 that extends away from the door 130. For example, the guide body 188 can extend from a door recess 190. In some embodiments, the guide body 188 can extend along a substantially linear path that is substantially perpendicular to the fixed axis of rotation 132. Thus, the guide body 188 can cooperate with the second cantilevered detent 174 of the articulating body 144 to promote linear translation of the door 130 with respect to the access panel 110 and bound the motion of the articulating body 144.

Figure 9:
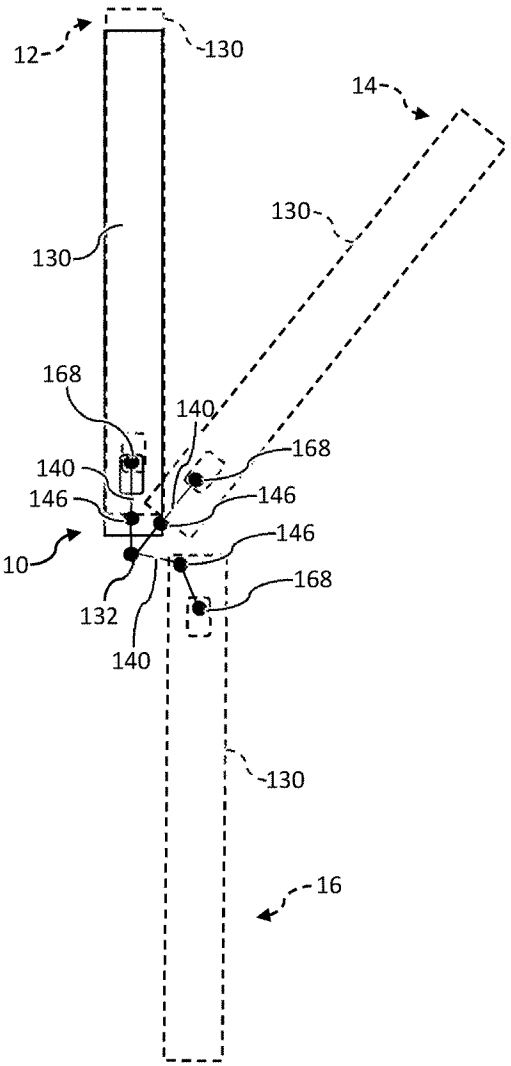
FIG. 9 schematically depicts motion of a multi-axis hinge according to one or more embodiments shown and described herein.

Referring collectively to FIGS. 1, 8, and 9, the multi-axis hinge 140 can be in rotational engagement with the access panel 110 and in rotational and sliding engagement with the door 130 to promote a sequence of motion of the door 130 with respect to the access panel 110. In some embodiments, the door 130 can be provided in a first state 10. When in the first state 10, the door 130 can be in a closed and locked position. Specifically, the door 130 can substantially enclose the doorway 112 of the access panel 110. The door 130 can be secured to the access panel 110 such that rotation of the door 130 around the fixed axis of rotation 132 is mitigated. For example, the peg members 133 of the door 130 can be received within the pocket members 114 of the access panel 100. That is, the locking member 136 of the peg member 133 can be received by the cavity bounded by the pocket member 114. It is noted that, when in the first state 10, the fixed axis of rotation 132, the hinge rotational axis 146, and the sliding rotational axis 168 can be constrained into substantially linear alignment. It is furthermore noted that the fixed axis of rotation 132, the hinge rotational axis 146, and the sliding rotational axis 168 can be substantially parallel throughout the sequence of motion.

Figure 10:
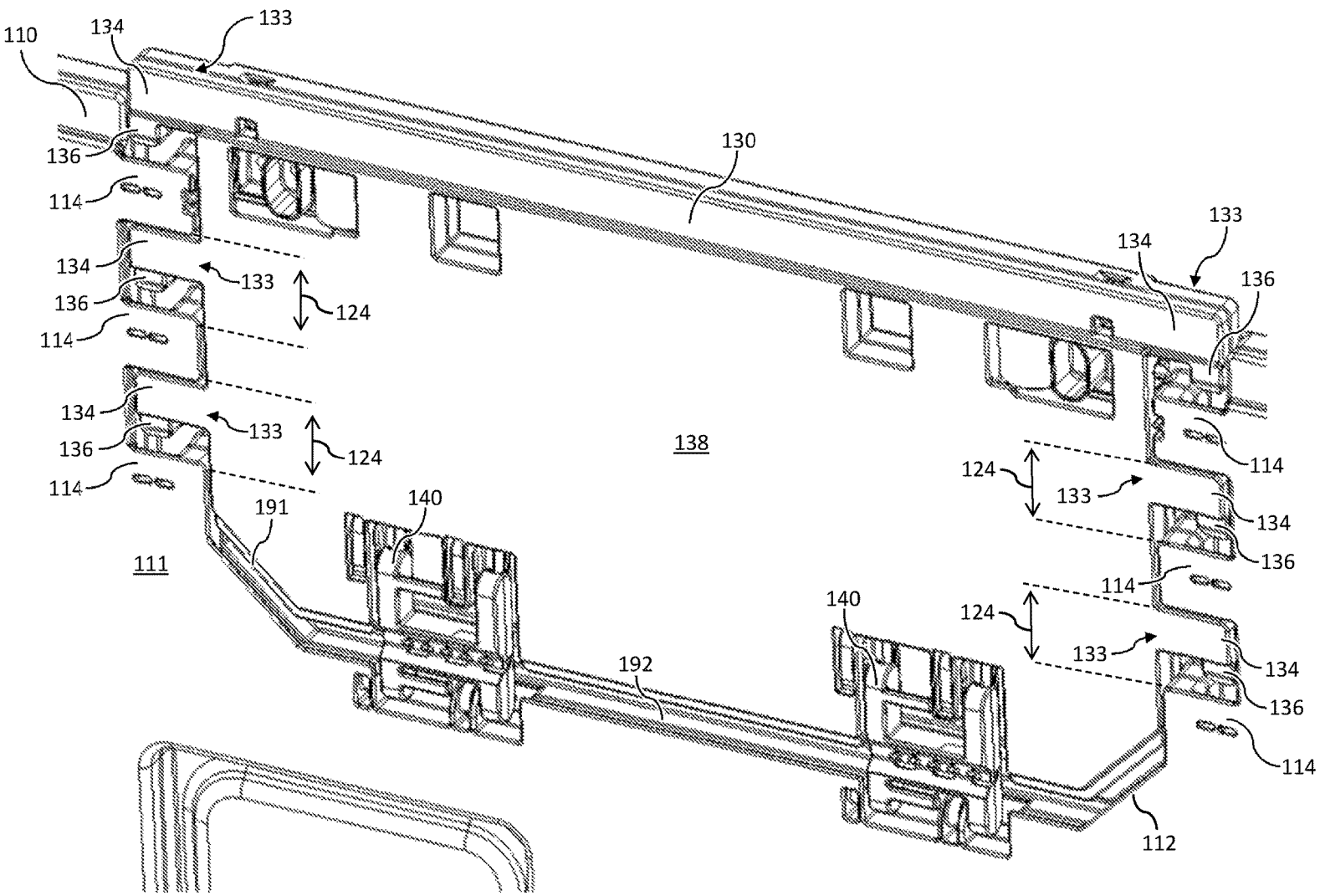
FIG. 10 schematically depicts the container of FIG. 1 with the door and multi-axis hinge in a second state according to one or more embodiments shown and described herein.
Figure 11:
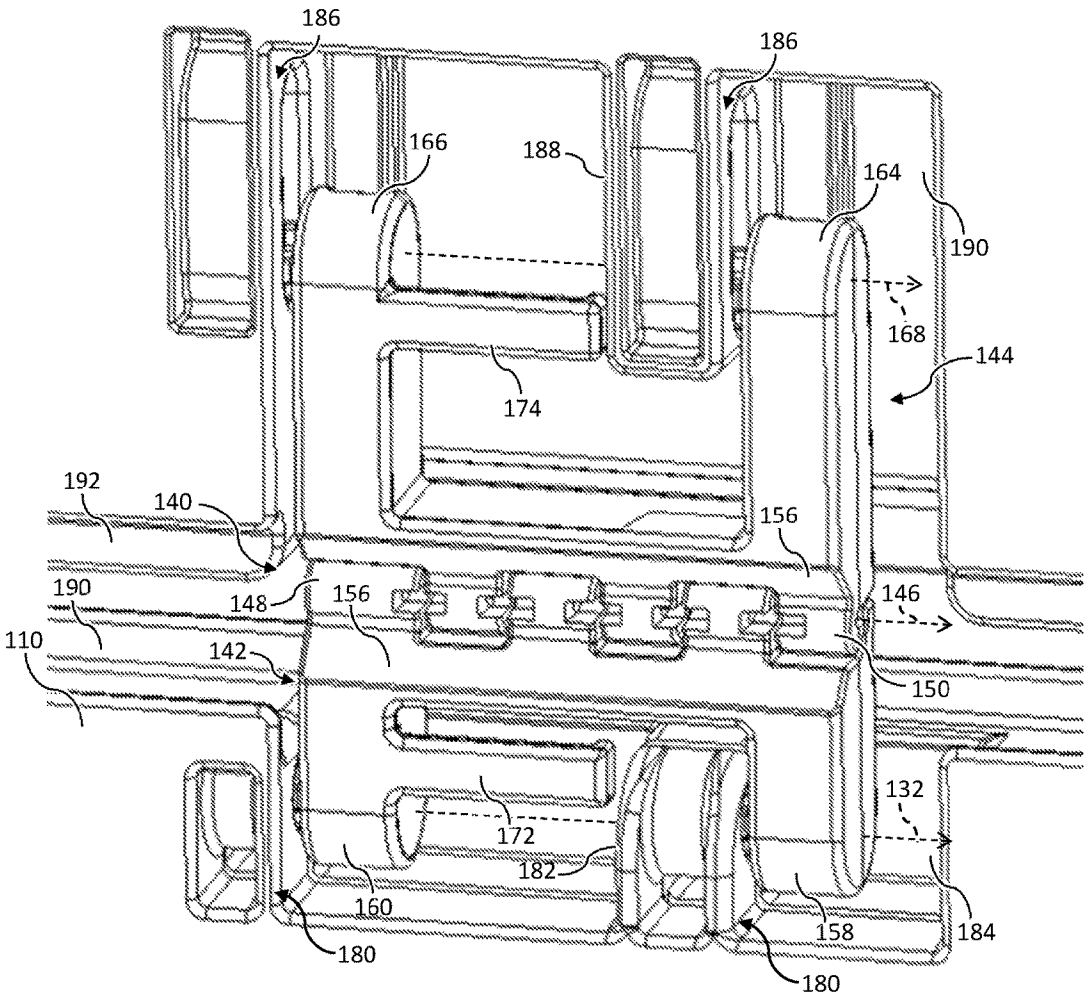
FIG. 11 schematically depicts an enlarged view of the multi-axis hinge of the container of FIG. 10 according to one or more embodiments shown and described herein.
Figure 12:
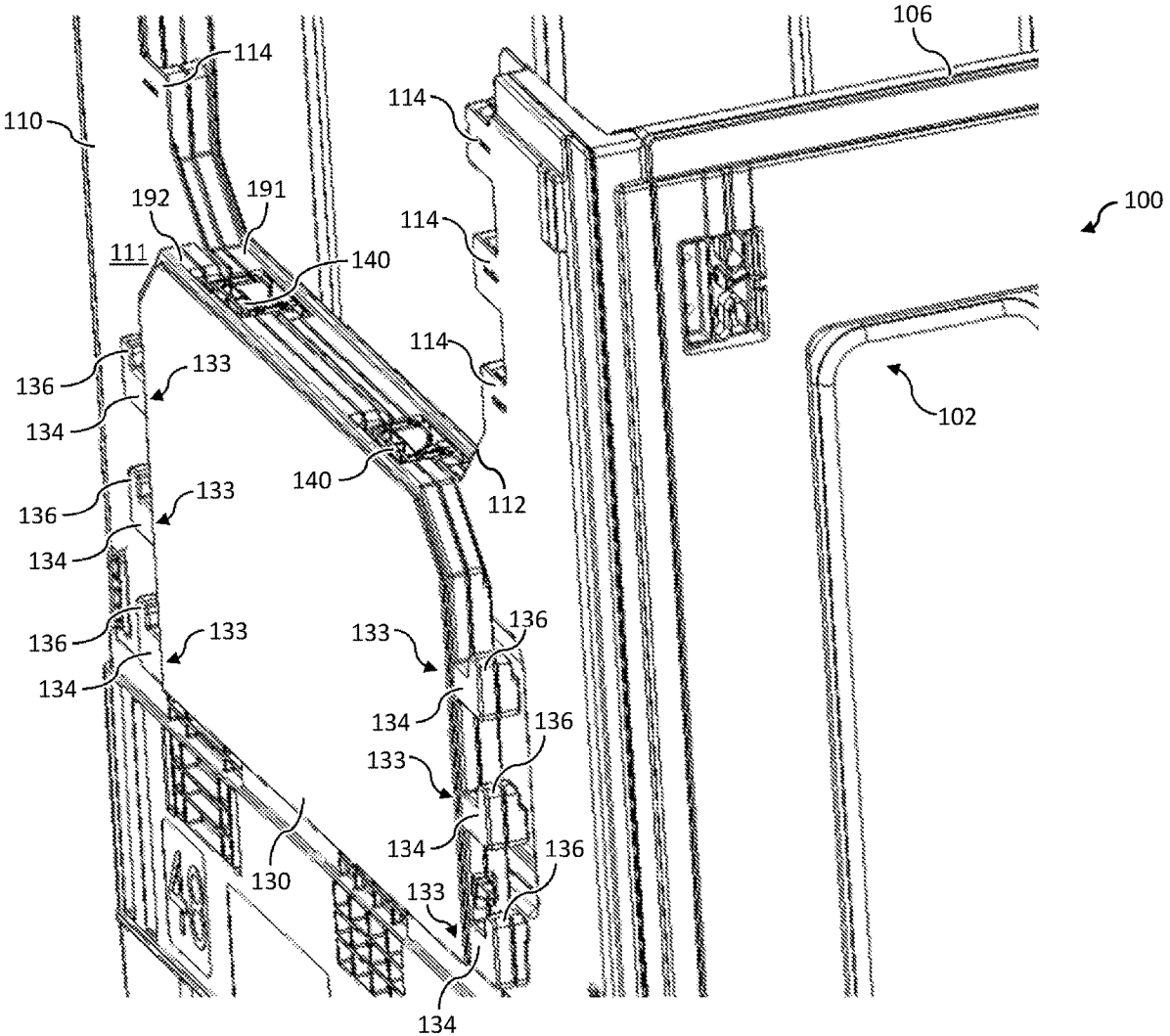
FIG. 12 schematically depicts side perspective view of the container of FIG. 2 according to one or more embodiments shown and described herein.

Referring collectively to FIGS. 9-11, the door 130 can be moved from the first state 10 to a second state 12. Likewise, the door 130 can be moved from the second state 12 to the first state 10. When in the second state, the door 130 can be in a closed and unlocked position. Specifically, the door 130 can substantially enclose the doorway 112 of the access panel 110. The door 130 can be unsecured from the access panel 110 such that rotation of the door 130 around the fixed axis of rotation 132 is permitted. For example, the peg members 133 of the door 130 can be offset from the pocket members 114 of the access panel 100 and positioned within the span 124 between the pocket members 114. In some embodiments, the span 124 can be larger than the peg members 133. Accordingly, rotation of the door 130 around the fixed axis of rotation 132 can be unobstructed by the pocket members 114.

In some embodiments, the access panel 110 can comprise a panel engagement feature 191 such as a recess or corrugation provided along the bottom of the doorway 112 that is configured to receive a bottom edge 192 of the door 130. Thus, when the door 130 is in the first state 10, the panel engagement feature 191 can overlap the bottom edge 192 of the door 130 such that rotation of the door 130 around the fixed axis of rotation 132 is mitigated. The amount of overlap can be less the span 124 between the pocket members 114. Accordingly, motion of the door 130 can be unobstructed by the panel engagement feature 191 when the door 130 is in the second state 12.

Generally, the door 130 can translate between the first state 10 and the second state 12 via substantially vertical motion along the doorway 112. Specifically, the door 130 can translate with respect to the sliding rotational axis 168. For example, the sliding engagement member 186 of the door 130 and the door engagement member 170 of the multi-axis hinge 140 can move linearly with respect to one another to transition between the first state 10 and the second state 12. When in the second state 12, the door 130 and the multi-axis hinge 140 can be free to rotate with respect to the fixed axis of rotation 132, the hinge rotational axis 146, and the sliding rotational axis 168. Accordingly, the door 130 can be opened by rotating along the fixed axis of rotation 132, the hinge rotational axis 146, the sliding rotational axis 168, or a combination thereof to transition from the second state 12 to a third state 14. Likewise, the door 130 can be closed by rotating along the fixed axis of rotation 132, the hinge rotational axis 146, the sliding rotational axis 168, or a combination thereof to transition from the third state 14 to the second state 12.

Referring collectively to FIGS. 1, 2, 3, 9 and 12, the door 130 can be moved to a fourth state 16 such that the door 130 lays substantially flat with respect to the access panel 110. Specifically, an exterior surface 138 of the door 130 can be placed into contact with an exterior surface 111 of the access panel 110. Accordingly, the multi-axis hinge 140 can promote a sequence of motion that permits the door 130 to be rotated throughout a wide angular range when moved throughout the first state 10 and the fourth state 16. In some embodiments, the wide angular range can be between about 170° and about 190° such as, for example, about 180° in one embodiment.

It should now be understood that embodiments of the multi-axis hinge can be utilized to provide a container with a door that is configured to close and fully open such that the door lays flat against a panel of the container. Moreover, the multi-axis hinges described herein can be provided to allow for a sequence of motion that can permit the use of locking mechanisms such as, for example, a peg and pocket system. Accordingly, the container can be provided with a door that is securely closed and easily opened. Moreover, the door can be folded flat to provide substantially unobstructed access to the container via a doorway.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue. Accordingly, a quantitative representation preceded by the term "about" should be understood to include the exact quantity in addition to a functionally equivalent range surrounding the exact quantity. Moreover, every explicitly described quantitative range described hereinabove should be understood to include every narrower quantitative range that is bounded by the explicitly described quantitative range, as if each narrower quantitative range was expressly described. For example, an explicitly described range of "between about 75° and about 105°" should be considered to include narrower range between (and inclusive of) the minimum value of 75° and the maximum value of 105°; i.e., all ranges beginning with a minimum value of 75° or more and ending with a maximum value of 105°; or less, e.g., between about 75° and about 100°, between about 80° and about 95°, etc.

Furthermore, it is noted that directional references such as, but not limited to, vertical, downwards, or the like have been provided for clarity and without limitation. Specifically, it is noted such directional references are made with respect to the normal operation of the containers described herein, i.e., with the container supported by a work surface. Thus, the directions may be reversed or otherwise oriented in any direction by making corresponding changes to the provided directional references with respect to the structure to extend the examples described herein.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A container comprising:

an access panel that defines a doorway that forms a recess extending from an upper perimeter of the container towards a base of the container;

a door configured to selectively close and open relative to the doorway;

a multi-axis hinge comprising a fixed access body in rotational engagement with an articulating body around a hinge rotational axis, wherein the fixed axis body is in rotational engagement with the access panel around a fixed axis of rotation, and wherein the multi-axis hinge comprises a door engagement member that is in rotational and sliding engagement with a sliding engagement member of the door around a sliding rotational axis to transition the door between a first state and a second state; and wherein in the first state the door is secured to the access panel to mitigate rotation of the door around the fixed axis of rotation, and in the second state the door is unsecured from the access panel and is permitted to (i) translate with respect to the sliding rotational axis and (ii) rotate around the fixed axis of rotation, the hinge rotational axis, the sliding rotational axis, or a combination thereof.

2. The container of claim 1, wherein:

the access panel comprises one or more pocket members formed adjacent to the doorway; and the door comprises one or more peg members configured to lock with the pocket members of the access panel in the first state to mitigate rotation of the door around the fixed axis of rotation.

3. The container of claim 2, wherein the door is permitted to rotate around the fixed axis of rotation when the peg members of the door are offset from the pocket members of the access panel.

4. The container of claim 3, wherein the access panel comprises an inner bounding feature that delimits the motion of the door with respect to the fixed axis of rotation.

5. The container of claim 3, wherein:

the sliding engagement member of the door and the door engagement member of the multi-axis hinge are configured to move linearly with respect to one another to transition between the first state and the second state; and the door is configured to be rotated around the fixed axis of rotation, the hinge rotational axis, the sliding rotational axis, or the combination thereof to transition from the second state to a third state.

6. The container of claim 5, wherein:

the door is configured to rotate with respect to the fixed axis of rotation, the hinge rotational axis, the sliding rotational axis or the combination thereof between the third state and a fourth state; and the door is configured in the fourth state to lay substantially flat with respect to the access panel.

7. The container of claim 1, wherein:

the access panel comprises a panel engagement feature corresponding to a recess or a corrugation configured to receive a bottom edge of the door; and the panel engagement feature overlaps the bottom edge of the door to mitigate rotation of the door around the fixed axis of rotation.

8. The container of claim 1, wherein the multi-axis hinge comprises a stop feature that sets a predetermined angle between the fixed axis body and the articulating body relative to the hinge rotational axis.

9. The container of claim 8, wherein the predetermined angle is between 75 degrees (°) and 105°.

10. The container of claim 1, wherein:

the fixed axis body comprises pillars extending from the hinge rotational axis towards the fixed axis of rotation; and each pillar comprises a panel engagement member, wherein each the panel engagement member is in rotational engagement with the access panel along the fixed axis of rotation.

11. The container of claim 10, wherein each panel engagement member comprises one of a substantially cylindrical pillar extending along the fixed axis of rotation, and a cylindrical bore formed along the fixed axis of rotation.

12. The container of claim 10, wherein the access panel comprises hinge engagement members each configured to form a rotational engagement with a respective panel engagement member of the fixed axis body.

13. The container of claim 1, wherein:

the articulating body comprises articulating pillars extending from the hinge rotational axis towards the sliding rotational axis;

the door comprises sliding engagement members; and each articular pillar comprises a respective door engagement member, wherein each sliding engagement member is configured to form a rotational and sliding engagement with the respective door engagement member such that the door can translate with respect to the sliding rotational axis.

14. The container of claim 1, wherein the container comprises thermoplastic material.

15. The container of claim 1, wherein the sliding engagement member comprises one of an elongated slot configured to receive the door engagement member in the rotational and sliding engagement, and a cylindrical pillar configured to receive the door engagement member in the rotational and sliding engagement.

16. The container of claim 15, wherein the sliding engagement member comprise a guide body that extends away from the door, and wherein the guide body is configured to cooperate with a cantilevered detent of the articulated body to promote linear translation of the door with respect to the access panel.

* * * * *